US005782464A

United States Patent [19]

Höhle et al.

[11] Patent Number: 5,782,464

[45] Date of Patent: Jul. 21, 1998

[54] FOLDING CYLINDER

[75] Inventors: Karl-Heinz Höhle; Winfried Militzer, both of Plauen, Germany

[73] Assignee: MAN Roland Druckmaschinen AG, Offenbach am Main, Germany

[21] Appl. No.: 668,914

[22] Filed: Jun. 24, 1996

[30] Foreign Application Priority Data

Jun. 23, 1995 [DE] Germany ..... 195 22 903.7

[51] Int. Cl.[6] ..... B41F 13/64; B41L 43/08

[52] U.S. Cl. ..... 270/19; 270/47

[58] Field of Search ..... 270/6, 10, 19, 270/42, 47, 43

[56] References Cited

U.S. PATENT DOCUMENTS 2,093,233 9/1937 Dean .

FOREIGN PATENT DOCUMENTS 0352625 1/1990 European Pat. Off. .

2011661 7/1971 Germany .

2309919 9/1974 Germany .

3838314 5/1990 Germany .

29502957 5/1995 Germany .

4415620 11/1995 Germany .

61086368 2/1984 Japan .

*Primary Examiner*—Hoang Nguyen

*Attorney, Agent, or Firm*—Cohen, Pontani, Lieberman, Pavane

[57] ABSTRACT

A folding cylinder for a folding apparatus of a rotary printing press having displaceable mechanisms which are connected with at least one spindle which is arranged in the folding cylinder, spaced radially from its shaft and can be turned by an adjustment spindle arranged in a coaxial bore in the shaft. The adjustment spindle is secured against rotation with respect to the shaft but is axially displaceable in its bore, and, axially spaced, is firmly attached to a pull which has two courses that extend towards each other, pass over a guide pulley, arranged in a radial opening of the bore to a drive disk which is fastened on the spindle and wrapped by the pull chain.

26 Claims, 4 Drawing Sheets

FOLDING CYLINDER

BACKGROUND OF THE INVENTION

1. Field of the Invention

The present invention relates to a folding cylinder for a rotary printing press.

2. Description of the Prior Art

A folding cylinder having an adjustable circumference is known from German reference DE 295 02 957.9 U1. The shaft of this folding cylinder is provided with a coaxial bore within which there is arranged a drivable adjustment spindle. The turning of the adjustment spindle is transmitted mechanically to paraxial spindles. Additionally, the adjustment spindle is coupled with radially adjustable support elements for the folding products, which elements vary the circumference of the folding cylinder.

German reference DE 38 38 314 A1uses the above-discussed device for adjusting the folding blades to different thicknesses of the folded products.

These solutions are complicated, particularly with respect to the transmission of the movement between the adjustment spindle and the spindle or spindles coupled with the displaceable mechanisms, such as support elements or folding blades, and are therefore technically demanding and relatively expensive.

SUMMARY OF THE INVENTION

Accordingly, it is an object of the present invention is to provide a folding cylinder which, by inexpensive and simple means, assures an adjustment of mechanisms during the operation of the machine.

Pursuant to this object, and others which will become apparent hereafter, one aspect of the present invention resides in a folding cylinder having a shaft with a coaxial bore in a radial opening extending from the bore, a folding cylinder body mounted on the shaft and at least one spindle turnably arranged in the folding cylinder body so as to be spaced axially from the shaft. Displaceable elements are connected to the at least one spindle, and an adjustment spindle is arranged in the coaxial bore of the shaft so that one end of the adjustment spindle projects from the bore and so as to be non-rotatable relative to the shaft and axially displaceable in the coaxial bore for turning the at least one spindle and displacing the elements. Pull means are axially spaced from the adjustment spindle and fixed to the adjustment spindle. The pull means includes guide pulleys mounted to the shaft in the radial opening, a drive disk mounted to the spindle and an elongate member which wraps around the drive disk and passes over the guide pulleys. The ends of the elongate member are fixed to the adjustable spindle.

The use of a pull means permits the simple transmission within a very narrow space, of the movement of adjustment from the coaxial adjustment spindle to the spindles connected to the displaceable mechanisms.

In another embodiment of the invention the displaceable elements are either displaceable folded products support elements arranged to vary the circumference of the folding cylinder or, displacement elements for folding blades.

In yet another embodiment of the invention the spindle is arranged in a plane perpendicular to the adjustment spindle. Still another embodiment provides the spindle to be paraxial to the adjustment spindle.

The drive disk can be toothed and the elongate member can be either a chain or a toothed belt. Additionally, the elongate member can be a rope or cord, in which case the drive disk need not be toothed.

In another embodiment of the invention a bearing housing is mounted on the end of the adjustment spindle outside the bore. A first guide pin is mounted to the bearing housing and the shaft paraxial to the adjustment spindle so as to secure the bearing housing against rotation relative to the shaft. In still another embodiment means can be provided for axially displacing the adjusting spindle. Also, a second pin is mounted in the bearing housing so as to be axially fixed and coaxial to the adjustment spindle. The displacing means is form locked with the guide pin.

In yet another embodiment of the invention the cylinder body includes two axially spaced disks that are rotatably mounted on the shaft. Each of the disks has recesses, as well as slots that extend obliquely to the disk radium. Eccentric pins are arranged at each end of the spindle and engaged in a form-locked manner into the recesses in the disk. A cross-bar is provided which has a pin at each end thereof. The pin at each end of the cross-bar is form-locked in a radial direction in one of the obliquely extending slots in the disks so that the cross-bar is radially displaceable paraxially in the cylinder body.

A further embodiment of the invention includes mounting means for mounting the spindle at an end of the folding cylinder. The mounting means includes a fork member having arms between which the drive disk is arranged. The ends of the spindle are attached to the arms of the fork member and the drive disk is mounted on the spindle so as to assure radial play which permits turning of the cylinder parts relative to one another.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
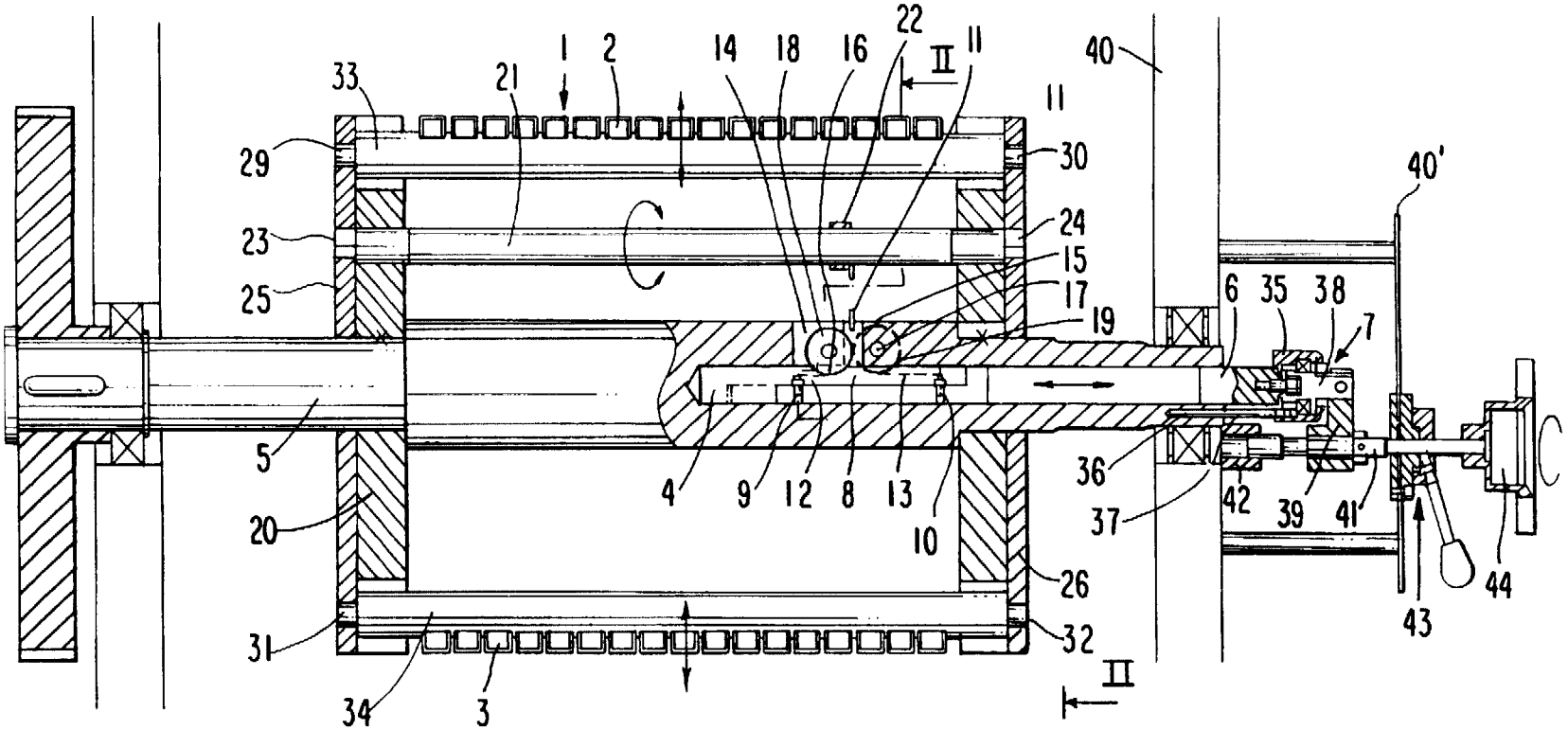
FIG. 1 is a longitudinal section through a folding cylinder having a displacement, in accordance with the invention, of its support elements for the folded products during operation of the printing machine along the line I—I in FIG. 2.

FIG. 1 shows a folding cylinder 1 with a circumference that can be varied by radially displaceable support elements 2, 3 for folded products (not shown).

For this purpose, within a coaxial bore 4 in the shaft 5 of the folding cylinder 1, an adjustment spindle 6 is displaceable axially by an adjustment drive 7 which can be actuated from outside of the covering of the machine.

The adjustment spindle 6 has a recess 8 at which ends of pulling means in the form of a chain 11 are fastened in spaced coaxial relation by pins 9, 10. The chain 11 has two courses 12, 13 which extend towards each other and are turned 90° by guide pulleys 18, 19 that are mounted, in a radial cut 14, 15 in the shaft 5 from the bore 4. Each guide pulley 18, 19 is mounted, on an eccentric pin 16, 17. The chain 11 passes from the guide pulleys 18, 19 with the interpositioning of a 90° angle offset member, to a toothed drive disk 22 which is fastened on a spindle 21 mounted paraxial to the shaft 5 in a cylinder body 20 which is firmly attached on to the shaft 5, and wraps around the disk 22.

The spindle 21 has, at each of its ends, an eccentric pin 23, 24 that engages, form-locked in its direction of rotation, into a disk 25, 26 which limits the folding cylinder 1 at its ends and is turnable on the shaft 5.

The disks 25, 26 are provided with slots 27, 28 (FIG. 2) which extend obliquely to the corresponding radius. Cross bars 33, 34 (FIG. 1) are provided, each of which is guided paraxially radially displaceable in the cylinder body 20 and is provided with a plurality of the support elements 2, 3 along the cylinder body 20. Each of the cross bars 33, 34 has pins 29, 30; 31, 32 that engage radially in a form-locked manner in the slots 27, 28 in the disks 25, 26.

As can be noted from FIG. 1, a bearing housing 35 is fastened on the end of the adjustment spindle 5 outside the bore 4. The housing is secured against turning with respect to the shaft 5 by a guide pin 37 which engages, paraxial to the adjustment spindle 6, into a bore hole 36 in the shaft 5.

Within the bearing housing 35 there is mounted, axially fixed, a guide pin 38 on which a connecting piece 39 is pivoted. The connecting piece 39 has a threaded bore through which a threaded spindle 41 passes which is mounted paraxial to a adjustment spindle 6 in a frame 40, 40'. The threaded spindle 41 also engages with another thread of opposite pitch, i.e. with a right-hand or left-hand thread, into a corresponding threaded hole in a guide piece 42 fastened on the frame 40. Outside the frame 40', the threaded spindle 41 can be fixed against rotation by a clamping device 43 and provided with an operating element 44.

Figure 3:
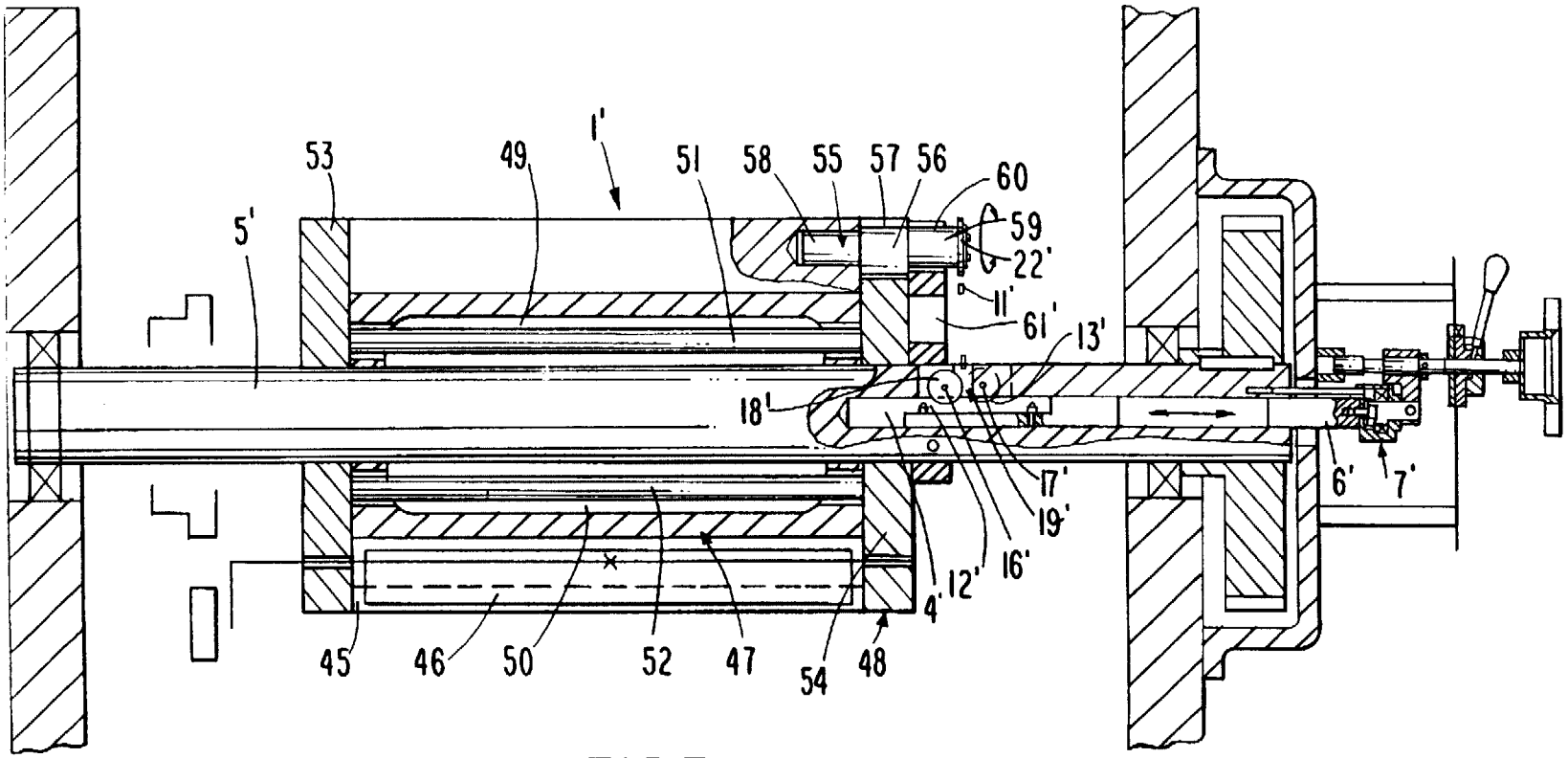
FIG. 3 is a longitudinal section through the folding cylinder with a displacement, in accordance with the invention, of its folding blades during the operation of the printing machine.

FIG. 3 shows a folding cylinder 1' consisting of two cylinder parts 47, 48 which are rotatably arranged on the shaft 5'. Each of the cylinder parts 47, 48 is provided with a folding blade of the same type as fixed folding blade 45 and movable counter folding blade 46 respectively. The fixed folding blades 45 are fastened on the inner solid cylinder part 47 and the counter folding blades 46 are mounted on disks 53, 54. The disks 53, 54 are connected together by cross bars 51, 52 which pass through axial openings 49, 50 in the inner part 47.

Figure 2:
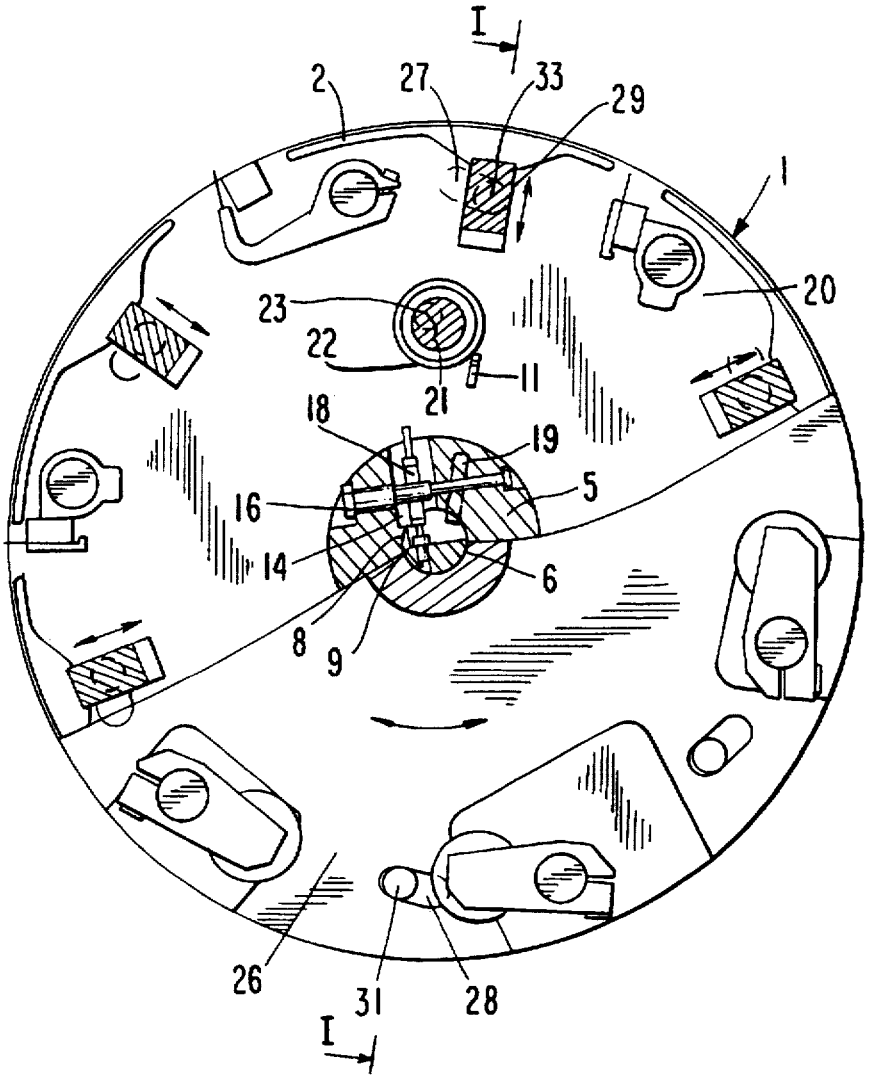
FIG. 2 is a cross section along the line II—II of FIG. 1.

For the adjusting of the folding blades to products of different thickness by the turning of the cylinder parts 47, 48, the means of FIGS. 1 and 2 except for the spindle 55 which is changed in shape and arrangement, are applied analogously. An eccentric section 56 of the spindle 55 is arranged in a cutout 57 in the disk 54, on the one hand form-locked in the direction of rotation of the disk 54 and, on the other hand, with radial play. The spindle 55 also has two concentric sections 58, 59 arranged on both sides of the eccentric section 56. The section 58 is mounted in the other cylinder part 47 and the section 59 is form-locked in the direction of rotation of the folding cylinder 1', passes through a cutout 60 in a driver 61 fastened on the shaft 5' and bears on the outside at its end the drive disk 22'.

Figure 5:
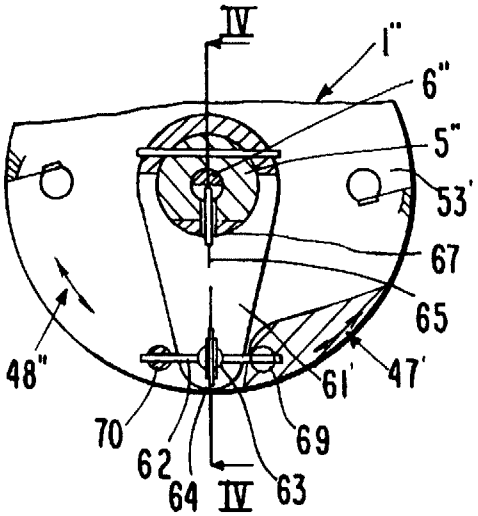
FIG. 5 is a cross section along the line V—V of FIG. 4.
Figure 4:
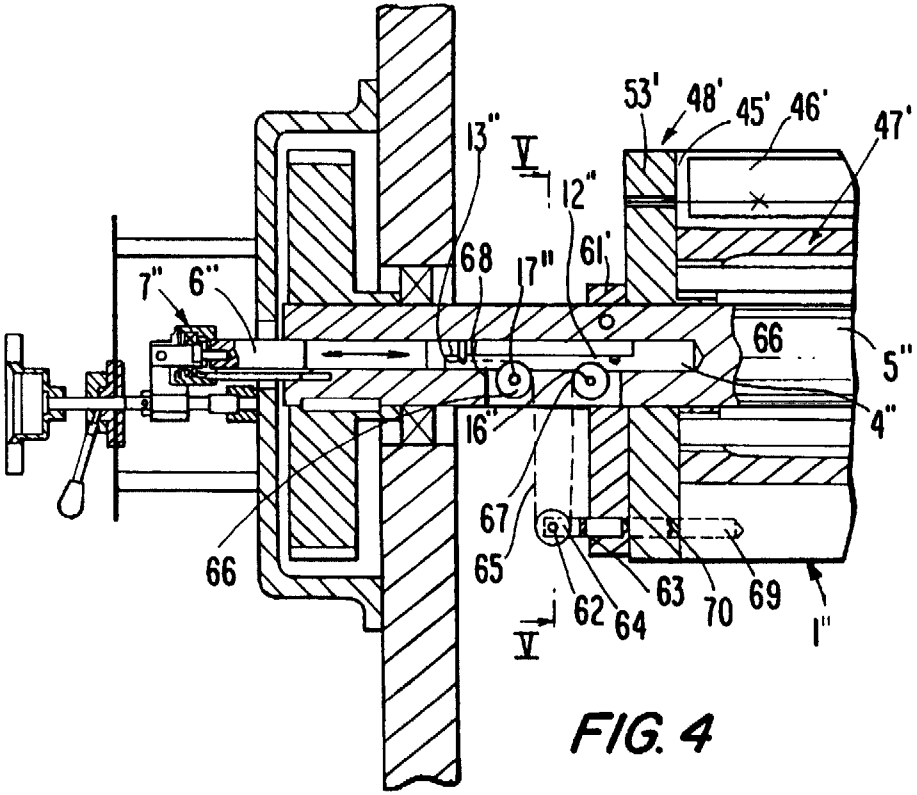
FIG. 4 is a view similar to FIG. 3 of another embodiment, with a different spindle arrangement along the line IV—IV of FIG. 5.

FIGS. 4 and 5 show a folding cylinder 1" developed in a manner similar to FIG. 3. The cylinder part 47', which bears the fixed folding blades 45', is turnable, differing from FIG. 3, with respect to the cylinder part 48' bearing the movable closing folding blades 46'. The cylinder part 47' is turnable by means of a spindle 62 which is arranged in a plane perpendicular to the adjustment spindle 6" and is supported twice, each time with radial play, in a fork 63 which is firmly attached to a driver 61. The spindle 62 bears, between the two support points, a drive disk 64, on basis of which turned 90° as compared with FIGS. 1 and 3, the angle offset members in the chain 65 are dispensed with, and the two guide disks 66, 67 are arranged in a continuous recess 68 which extends paraxial to the adjustment spindle 6".

The spindle 62 engages via a thread arranged on its ends, in each case with opposite pitch of the same size, into a threaded bore hole in pins 69, 70 which are turnable in the corresponding cylinder parts 47' and 48' respectively. In this connection, the pin 69 for the inner-lying cylinder part 47' passes through a cutout in the outer disk 53' of the other cylinder part 48' with radial play which permits the mutual turning of the cylinders 47', 48' with respect to each other.

It is also possible to displace the support elements for the folded products or folding blades by means of several spindles which are connected in each case separately via a drive disk, pull means, and guide disks, to the displacement spindle. These drive systems are arranged axially offset with respect to the displacement spindle. The support elements can also be jointly displaced by means of several spindles paraxial to the displacement spindle to which they are connected, in each case via a drive disk, by endless pull means extending in a vertical plane in drive connection, and via a spindle by means of the separate drive disk, pull means and guide disks thereof, to the displacement spindle.

In both cases, the pull means, together with the corresponding drive means can, depending on the specific development of the folding cylinder, be arranged both within it and at its end.

The invention is not limited by the embodiments described above which are presented as examples only but can be modified in various ways within the scope of protection defined by the appended patent claims.

We claim:

1. A folding cylinder for a folding apparatus of a rotary printing press, comprising:

a shaft having a coaxial bore and a radial opening extending from the bore;

a folding cylinder body mounted on the shaft;

at least one spindle turnably arranged in the folding cylinder body so as to be spaced radially from the shaft;

displaceable elements connected to the at least one spindle;

an adjustment spindle arranged in the coaxial bore of the shaft so that one end of the adjustment spindle projects from the bore and so as to be non-rotatable relative to the shaft and axially displaceable in the coaxial bore for turning the at least one spindle; and pull means including guide pulleys mounted to the shaft in the radial opening, a drive disk mounted to the spindle and an elongate member arranged to wrap around the drive disk and pass over the guide pulleys, the elongate member having ends that are fixed to the adjustable spindle axially spaced from one another.

2. A folding cylinder according to claim 1, wherein the displaceable elements are displaceable folded product support elements arranged to vary circumference of the folding cylinder with turning of the at least one spindle.

3. A folding cylinder according to claim 1, wherein the displaceable elements are displacement elements for folding blades, said elements being arranged to displace with turning of the at least one spindle.

4. A folding cylinder according to claim 1, wherein the spindle is arranged to be paraxial to the adjustment spindle.

5. A folding cylinder according to claim 1, wherein the spindle is arranged in a plane perpendicular to the adjustment spindle.

6. A folding cylinder according to claim 1, the drive disk is toothed, and the elongate member is a chain.

7. A folding cylinder according to claim 1, wherein the drive disk is toothed and the elongate member is a toothed belt.

8. A folding cylinder according to claim 4, wherein the pull means further includes courses with a 90° angle offset member between each guide disk and the drive disk.

9. A folding cylinder according to claim 1, wherein the elongate member is a rope wrapped around the drive disk.

10. A folding cylinder according to claim 1, wherein the guide pulleys are arranged at an angle to each other in two different planes lying paraxial to the shaft in a direction of a corresponding end of the elongate member.

11. A folding cylinder according to claim 1, wherein the guide pulleys are arranged in a plane paraxial to the shaft so as to leave a space for the elongate member and the drive disk.

12. A folding cylinder according to claim 1, and further comprising displaceable eccentric pins arranged to mount the guide disks to the shaft.

13. A folding cylinder according to claim 1, and further comprising two pins seated radially in the adjustment spindle, ends of the elongate member being respectively attached to the pins.

14. A folding cylinder according to claim 1, and further comprising a bearing housing mounted on the end of the adjustment spindle outside the bore, and a first guide pin mounted to the bearing housing and the shaft paraxial to the adjustment spindle so as to secure the bearing housing against rotation relative to the shaft.

15. A folding cylinder according to claim 14, and further comprising means for axially displacing the adjustment spindle, and a second guide pin mounted in the bearing housing so as to be axially fixed and coaxial to the adjustment spindle, the axial displacing means being form locked with the second guide pin.

16. A folding cylinder according to claim 15, wherein the axial displacing means includes a connecting piece pivotably mounted on the second guide pin, the connecting piece having a bore hole paraxial to the adjustment spindle, and a threaded spindle mounted in the bore hole of the connecting piece so as to be paraxial to the adjustment spindle.

17. A folding cylinder according to claim 16, and further comprising a frame arranged to surround the one end of the adjustment spindle, the threaded spindle passing through the frame so as to have a portion outside the frame, still further comprising a clamping device connected to the frame and the threaded spindle portion outside the fame, and an operating element connected to an end of the threaded spindle outside the frame.

18. A folding cylinder according to claim 4, wherein the cylinder body includes two axially spaced disks rotatably mounted on the shaft, each of the disks having recesses, and slots that extend obliquely to the disk radius, and further comprising eccentric pins arranged at each end of the spindle so as to engage in a form-locked manner into the recesses in the disk, still further comprising a cross-bar having a pin at each end thereof, each pin at the end of the cross-bar being form locked in a radial direction in one of the obliquely extending slots in the disks so that the cross-bar is radially displaceable paraxially in the cylinder body, the displaceable elements including support elements mounted on the cross-bar.

19. A folding cylinder according to claim 4, wherein the folding cylinder body includes two cylinder parts rotatably arranged on the shaft, fixed folding blades arranged on one of the cylinder parts and moveable counter-folding blades correspondingly arranged on another of the cylinder parts, the spindle having at least one eccentric section that engages into one of the two cylinder parts, the spindle further having a concentric section, and further comprising a drive member fixed to the shaft and engaged with the concentric section of the spindle.

20. A folding cylinder according to claim 19, wherein the drive disk is mounted on an end of the spindle which extends beyond an outer side of the drive member.

21. A folding cylinder according to claim 5, and further comprising a drive member rotatably fixed relative to the shaft, and means, connected to the drive member, for mounting the spindle at one end of the folding cylinder body, the at least one spindle having two ends, each of the ends having a thread with a different pitch, the folding cylinder body including a cylinder part rotatably arranged on the shaft and having folding blades mounted thereto, still further comprising an intermediate piece connected to the cylinder part and having a threaded hole, the ends of the spindle engaging in the threaded hole of the intermediate piece.

22. A folding cylinder according to claim 21, wherein the mounting means includes a fork member having arms between which the drive disk is arranged, the ends of the spindle being attached to the arms of the fork member and the drive disk being mounted on the spindle so as to assure radial play which permits turning of the cylinder parts relative to one another.

23. A folding cylinder according to claim 21, wherein the intermediate piece is a pin rotatably mounted in a corresponding cylinder part, the spindle being mounted in the threaded bore of the intermediate piece.

24. A folding cylinder according to claim 21, wherein the pitch of the threaded ends of the spindle is opposite but of equal size.

25. A folding cylinder according to claim 1, wherein a plurality of spindles are provided, each spindle of the plurality of spindles being in drive connection with the displacement spindle, further comprising separate pull means for each of the spindles, said pull means being arranged offset axially to the displacement spindle.

26. A folding cylinder according to claim 4, wherein a plurality of spindles are provided paraxial to the displacement spindle, and further comprising respective drive disks and additional pull means extending in a vertical plane for connecting together the spindles, the pull means connecting the adjustable spindle to one of the plurality of spindles.

* * * * *